US008442237B2

(12) United States Patent
Kim et al.

(10) Patent No.: US 8,442,237 B2
(45) Date of Patent: May 14, 2013

(54) APPARATUS AND METHOD OF REPRODUCING VIRTUAL SOUND OF TWO CHANNELS

(75) Inventors: Sun-min Kim, Yongin-si (KR); Sang-il Park, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 2007 days.

(21) Appl. No.: 11/514,961

(22) Filed: Sep. 5, 2006

(65) Prior Publication Data

US 2007/0133831 A1 Jun. 14, 2007

Related U.S. Application Data

(60) Provisional application No. 60/719,191, filed on Sep. 22, 2005.

(30) Foreign Application Priority Data

Dec. 13, 2005 (KR) ..... 2005-0122433

(51) Int. Cl.
*H04R 5/00* (2006.01)

(52) U.S. Cl.
USPC ..... 381/1; 381/17; 381/18; 381/309; 381/310

(58) Field of Classification Search ..... 381/1, 17–19, 381/309–310
See application file for complete search history.

(56) References Cited

U.S. PATENT DOCUMENTS 5,657,391 A * 8/1997 Jyosako ..... 381/1
5,742,689 A 4/1998 Tucker et al.
6,385,320 B1 5/2002 Lee
6,498,857 B1 12/2002 Sibbald (Continued)

FOREIGN PATENT DOCUMENTS

EP 0 977 464 2/2000
JP 05-41900 2/1993

(Continued)

OTHER PUBLICATIONS

PCT International Search Report dated Dec. 27, 2006 issued in PCT/KR2006/003772.

(Continued)

*Primary Examiner* — Disler Paul
(74) *Attorney, Agent, or Firm* — Stanzione & Kim, LLP

(57) ABSTRACT

A stereo sound generation apparatus and method of reproducing multi-channel sound input signals through two-channel speakers. The stereo sound generation apparatus includes: a preprocessing filter unit to reduce correlation between two-channel audio signals from among multi-channel audio signals and to generate a presence perception, a virtual speaker filter unit to convert the two-channel audio signals output from the preprocessing filter unit into a virtual sound source at a predetermined position, a signal correction filter unit to correct a signal characteristic between remaining multi-channel audio signals excluding the two-channel audio signals, and the two-channel audio signals output from the virtual speaker filter unit, and an addition unit to add signals to be output to a first channel from among the multi-channel audio signals output from the virtual speaker filter unit and the signal correction filter unit, and to add signals to be output to a second channel from among the multi-channel audio signals output from the virtual speaker filter unit and the signal correction filter unit.

26 Claims, 11 Drawing Sheets

U.S. PATENT DOCUMENTS

| | | | | |
|---|---|---|---|---|
| 6,614,910 | B1 | 9/2003 | Clemow et al. | |
| 6,668,061 | B1 | 12/2003 | Abel | |
| 7,242,782 | B1 * | 7/2007 | Kasai et al. | 381/97 |
| 7,466,830 | B2 * | 12/2008 | Miyashita | 381/103 |
| 8,054,980 | B2 * | 11/2011 | Wu et al. | 381/17 |
| 2005/0047618 | A1 | 3/2005 | Davis et al. | |
| 2005/0135643 | A1 * | 6/2005 | Lee et al. | 381/309 |
| 2005/0271213 | A1 | 12/2005 | Kim | |
| 2005/0281408 | A1 | 12/2005 | Kim et al. | |
| 2006/0115091 | A1 * | 6/2006 | Kim et al. | 381/18 |

FOREIGN PATENT DOCUMENTS

| | | |
|---|---|---|
| JP | 05-168096 | 7/1993 |
| JP | 2001-507879 | 6/2001 |
| JP | 2004-064363 | 2/2004 |
| KR | 1998-060755 | 10/1998 |
| KR | 1019990039737 | 6/1999 |
| KR | 1019990051115 | 7/1999 |
| KR | 2000-0075880 | 12/2000 |
| KR | 2001/47701 | 6/2001 |
| KR | 2004-0004548 | 1/2004 |
| KR | 2005-0012085 | 1/2005 |
| KR | 2005-60789 | 6/2005 |
| KR | 2005-119605 | 12/2005 |
| WO | 99/49574 | 9/1999 |
| WO | WO 2006/057521 | 6/2006 |

OTHER PUBLICATIONS

Netherlands Search Report dated Jun. 19, 2008 issued in NL 1032538.

* cited by examiner

APPARATUS AND METHOD OF REPRODUCING VIRTUAL SOUND OF TWO CHANNELS

CROSS-REFERENCE TO RELATED APPLICATIONS

This application claims the benefit of Korean Patent Application No. 10-2005-0122433, filed on Dec. 13, 2005, in the Korean Intellectual Property Office, and U.S. Provisional Application No. 60/719,191, filed on Sep. 22, 2005, the disclosures of which are incorporated herein in their entirety by reference.

BACKGROUND OF THE INVENTION

1. Field of the Invention

The present general inventive concept relates to a stereo sound system, and more particularly, to a stereo sound generation apparatus and method of generating virtual sound sources for two-channel audio signals while adjusting output gains and time delays for remaining channel audio input signals such that a natural stereo perception can be provided.

2. Description of the Related Art

Generally, an audio reproduction system provides a surround sound effect, such as a 5.1 channel system, by using only two speakers.

A conventional stereo sound generation system for reproducing 5.1 channel audio through 2-channel speakers is described in WO 99/49574 (PCT/AU99/00002, filed 6 Jan. 1999, entitled, "AUDIO SIGNAL PROCESSING METHOD AND APPARATUS").

FIG. 1 is a block diagram illustrating the conventional stereo sound generation system 1. Referring to FIG. 1 the conventional sound generation system includes a part associated with a convolution of an input signal with an impulse response by using a head related transfer function (HRTF) as a down-mixing technique to generate a 5.1-channel stereo feeling through 2-channel speakers, and a part for adding the convoluted signals to two channels.

Referring to FIG. 1, 5.1 channel audio signals are input. The 5.1 channels include a left front channel 2, a right front channel, a center front channel, a left surround channel, a right surround channel, and a low frequency effect (LFE) channel. Accordingly, in relation to the left front channel 2, a corresponding left front impulse response function 4 is convoluted with a left front signal 3. The left front impulse response function 4 is an impulse response to be received by a left ear of a listener as an ideal spike output from a left front channel speaker placed at an ideal position, and uses the HRTF. An output signal 7 is added to a left channel signal 10 for a headphone. Similarly, an impulse response function 5 corresponding to a right ear of the listener for a right channel speaker is convoluted with the left front signal 3 in order to generate an output signal 9 to be added to a right channel signal 11.

Accordingly, audio signals of the left front channel 2, the right front channel, the center front channel, the left surround channel, the right surround channel, and the LFE channel are convoluted with corresponding impulse responses, respectively, such that two signals, i.e., a left signal and a right signal, are generated for each channel. Then, left signals of the six channels are added to each other and right signals of the six channels are added to each other such that 2-channel output signals are finally obtained.

If the 2-channel output signals are reproduced, a stereo feeling is generated by two actual speakers as if virtual speakers, left front, right front, center, left surround, and right surround speakers, are disposed around the listener.

However, according to the conventional stereo sound generation system 1 illustrated in FIG. 1, if a correlation between the left surround channel and the right surround channel is high, it is difficult to generate a sound image at a rear of the listener.

Here, the high correlation indicates that sound characteristics are almost the same, and the reason why it is difficult to generate a sound image at the rear of the listener if the correlation is high is explained as follows.

A virtual sound source is formed using an HRTF, which is a characteristic of an acoustic signal at the ears of the listener (i.e., a human ear) depending on the shapes of the head and the ears of the listener. With the HRTF, 3-dimensional audio can be perceived by a phenomenon resulting from characteristics of complicated paths, such as diffraction on the skin of the listener's head, and reflection by a pinna, varies with respect to an incident direction of sound, in addition to the simple path differences, such as an inter-aural level difference (ILD) and an inter-aural time difference (ITD).

However, although the HRTF enables easy distinction between left and right sound images on a horizontal surface, it is difficult to distinguish front and rear sound images due to a standard HRTF error. In order to distinguish the positions of front and rear sound images, an accurate frequency of an actual user should be measured. Since a standard dummy head is typically used, front/rear confusion occurs due to a difference between frequency characteristics of the dummy head and the actual user.

When the surround channels are used, the effect of the surround channels can be obtained only when sound images are positioned at a left rear and a right rear of the listener. When the correlation of the audio input signals of the left and right surround channels is high, the sound image is positioned at the center of the rear of the listener. Furthermore, due to the use of the standard dummy head, the front/rear confusion also occurs, and it is difficult to obtain the effect of the surround channels.

SUMMARY OF THE INVENTION

The present general inventive concept provides a stereo sound generation apparatus and method, by which a stereo perception provided by a multi-channel speaker system is generated by using a 2-channel speaker system. Additionally, in multi-channel audio signals, virtual sound sources for two channel audio signals are generated and output gains and time delays for remaining channel audio signals (i.e., excluding the two channel audio signals) are adjusted so that a natural stereo perception can be provided.

Additional aspects of the present general inventive concept will be set forth in part in the description which follows and, in part, will be obvious from the description, or may be learned by practice of the general inventive concept.

The foregoing and/or other aspects of the present general inventive concept may be achieved by providing a stereo sound generation apparatus to reproduce multi-channel audio input signals as two channel outputs, the apparatus including a preprocessing filter unit to reduce a correlation between two-channel audio signals from among the multi-channel audio input signals and to generate a presence perception, a virtual speaker filter unit to convert the two-channel audio signals output from the preprocessing filter unit into a virtual sound source at a predetermined position, a signal correction filter unit to correct a signal characteristic between remaining ones of the multi-channel audio input signals excluding the two-channel audio input signals, and the two-channel audio signals output from the virtual speaker filter unit, and an addition unit to add signals to be output to a first channel from among the multi-channel audio signals output from the virtual speaker filter unit and the signal correction filter unit, and to add signals to be output to a second channel from among the multi-channel audio signals output from the virtual speaker filter unit and the signal correction filter unit.

The foregoing and/or other aspects of the present general inventive concept may also be achieved by providing a stereo sound generation apparatus to reproduce multi-channel audio input signals as two-channel audio signal outputs, the apparatus including a preprocessing filter unit to group-delay a predetermined frequency component of two-channel audio signals selected among the multi-channel audio input signals, a virtual speaker filter unit to convert the selected two-channel audio signals output from the preprocessing filter unit into a virtual sound source at a predetermined position, a signal correction filter unit to correct an output level and time delay between remaining multi-channel audio signals excluding the selected two-channel audio signals, and the selected two-channel audio signals output from the virtual speaker filter unit, and an addition unit to add signals to be output to a first channel from among the multi-channel audio signals output from the virtual speaker filter unit and the signal correction filter unit, and to add signals to be output to a second channel from among the multi-channel audio signals output from the virtual speaker filter unit and the signal correction filter unit.

The foregoing and/or other aspects of the present general inventive concept may also be achieved by providing a stereo sound generation apparatus to perform convolution of two matrix structures with predetermined sizes by calculating a binaural synthesizer and crosstalk canceller in relation to two channels signals in advance, the apparatus including a delay unit to delay first and second channel input signals with respective predetermined delay values, a gain unit to adjust an output level of each of the first and second channel input signals delayed in the delay unit, a first addition unit to add the first channel input signal and the gain- and delay-adjusted second channel signal, a first filter unit to adjust a frequency characteristic of a signal output from the first addition unit, a second addition unit to add the second channel input signal and the gain- and delay-adjusted first channel signal, and a second filter unit to adjust a frequency characteristic of a signal output from the second addition unit.

The foregoing and/or other aspects of the present general inventive concept may also be achieved by providing a stereo sound generation apparatus to reproduce multi-channel audio input signals as two-channel output signals, the apparatus including a virtual surround filter unit to reduce a correlation between two surround channel audio signals from among the multi-channel audio input signals and to convert the two surround channel audio signals into virtual sound sources at predetermined positions, a wide stereo generation unit to generate two front channel audio signals among the multi-channel audio input signals as widening stereo signals by convoluting a binaural synthesis and a crosstalk canceller, and a signal correction filter unit to correct an output level and time delay between remaining multi-channel audio input signals excluding the two surround channel signals and the two front channel audio signals, and the channel audio signals output from the virtual surround filter unit and the wide stereo generation unit.

The foregoing and/or other aspects of the present general inventive concept may also be achieved by providing a stereo sound generation apparatus, including a first filter unit to receive surround audio signals from among at least five input audio signals and to generate virtual sound sources at predetermined locations with respect to a listening point, a second filter unit to receive remaining audio signals from among the at least five input audio signals and to compensate for a delay and gain difference induced in the surround audio signals by the virtual surround filter unit, and an output unit to combine first selected ones of the surround audio signals and the remaining audio signals to produce a left output signal and to combine second selected ones of the surround audio signals and the remaining audio signals to produce a right output signal.

The foregoing and/or other aspects of the present general inventive concept may also be achieved by providing a stereo sound generation apparatus to reproduce multi-channel audio input signals as two-channel output signals, the apparatus including a virtual surround filter unit to reduce a correlation between the two-channel audio signals from among the multi-channel audio input signals to generate a presence perception, and to convert the two-channel audio signals into a virtual sound source at a predetermined position, a signal correction filter unit to correct a signal characteristic between remaining ones of the multi-channel audio input signals excluding the two-channel audio input signals and the two-channel audio signals output from the virtual surround filter unit, and an addition unit to add signals to be output to a first channel from among the multi-channel audio signals output from the virtual surround filter unit and the signal correction filter unit, and to add signals to be output to a second channel from among the multi-channel audio signals output from the virtual surround filter unit and the signal correction filter unit.

The foregoing and/or other aspects of the present general inventive concept may also be achieved by providing a stereo sound generation method of applying a virtual effect to two channel signals, the method including dividing frequency bands of first and second channel signals into a high frequency band and a low frequency band, decimating each of the first and second channel low frequency band signals, generating virtual sound sources by reducing a correlation between respective decimated signals and outputting the virtual sound sources at predetermined positions, performing interpolation with respect to the first and second channel signals output as the virtual sound sources, low-pass filtering the interpolated first and second channel signals, and adding the low-pass filtered first channel signal and the delayed high frequency first channel signal, and adding the low-pass filtered second channel signal and the delayed high frequency second channel signal.

The foregoing and/or other aspects of the present general inventive concept may also be achieved by providing a stereo sound generation method of applying a virtual effect to two channel signals, the method including performing preprocessing filtering by reducing a correlation between first and second channel signals and generating a presence perception, dividing frequency bands of the preprocessing-filtered first and second channel signals into a high frequency band and a low frequency band, decimating each of the first and second channel low frequency band signals, performing virtual speaker filtering by outputting the respective decimated signals as virtual sound sources at predetermined positions, performing interpolation with respect to the virtual speaker filtered first and second channel signals output as the virtual sound sources, low-pass filtering the interpolated first and second channel signals, and adding the low-pass filtered first channel signal and the delayed high frequency first channel signal, and adding the low-pass filtered second channel signal and the delayed high frequency second channel signal.

The foregoing and/or other aspects of the present general inventive concept may also be achieved by providing a stereo sound generation method of reproducing multi-channel audio input signals as two channel outputs, the method including reducing a correlation between two-channel audio signals from among the multi-channel audio input signals and generating a presence perception, converting the two-channel audio signals into a virtual sound source at a predetermined position, and adjusting remaining multi-channel audio signals, excluding the two-channel audio signals, according to an output level and a time delay of the two channel audio signals, and outputting the adjusted signals as two-channel signals.

The foregoing and/or other aspects of the present general inventive concept may also be achieved by providing a stereo sound generation method of generating virtual speakers at the left rear and right rear of a listener, the method including adjusting a gain and delay of a left channel input signal, adjusting a gain and delay of a right channel input signal, adding the left channel input signal and the gain- and delay-adjusted right channel signal to obtain a first added signal, adjusting a frequency characteristic of the first added signal and outputting a result to a left speaker, adding the right channel input signal and the gain- and delay-adjusted left channel signal to obtain a second added signal, and adjusting a frequency characteristic of the second added signal and outputting a result to a right speaker.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
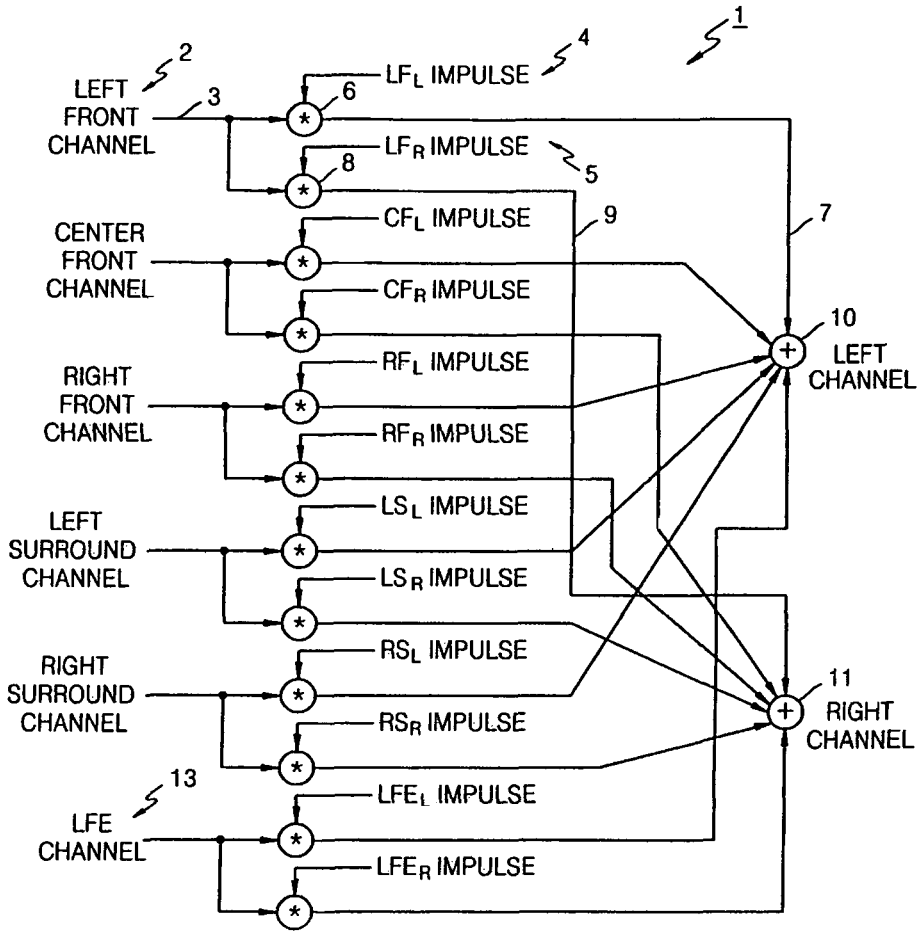
FIG. 1 (PRIOR ART)
FIG. 1 is a block diagram illustrating a conventional stereo sound generation system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
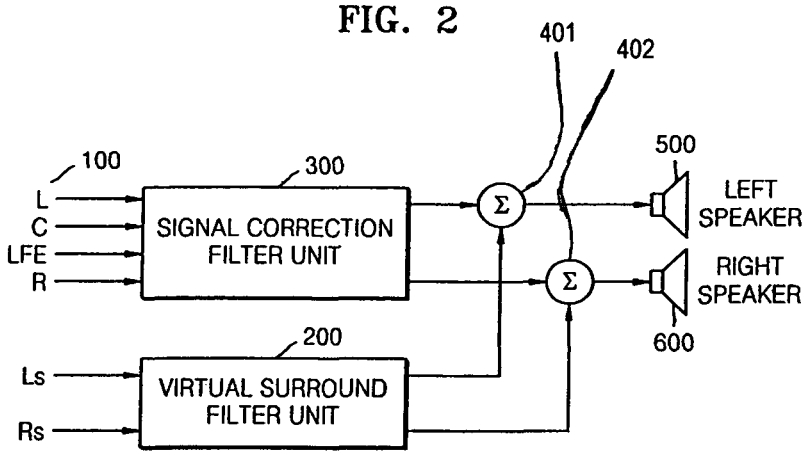
FIG. 2 is a block diagram illustrating a stereo sound generation apparatus to reproduce multi-channel audio signals through 2 channels according to an embodiment of the present general inventive concept.

FIG. 2 is a block diagram illustrating a stereo sound generation apparatus to reproduce multi-channel audio signals through 2 channels according to an embodiment of the present general inventive concept.

The stereo sound generation apparatus illustrated in FIG. 2 includes multi-channel audio signals 100, a virtual surround filter unit 200, a signal correction filter unit 300, a first addition unit 401, a second addition unit 402, a left channel speaker 500, and a right channel speaker 600.

The multi-channel audio signals 100 include a left channel signal (L), a center channel signal (C), a low frequency effect channel signal (LFE), a right channel signal (R), a left surround channel signal (Ls), and a right surround channel signal (Rs). Although 5.1 channels are explained as an example in the present embodiment, it should be understood by those of ordinary skill in the art that the present embodiment can be applied to other multi-channel signals, such as 6.1 channels and 7.1 channels.

The virtual surround filter unit 200 has inputs for the left surround channel signal (Ls) and the right surround channel signal (Rs) from among the multi-channel audio signals.

The virtual surround filter unit 200 reduces a correlation between the input left and right surround channel signals Ls and Rs while generating a presence perception and virtual sound sources at a left rear and a right rear of the listener. This operation will now be explained in detail with reference to FIGS. 3 through 7.

The signal correction filter unit 300 has inputs for the left channel signal (L), the center channel signal (C), the low frequency effect channel signal (LFE), and the right channel signal (R) from among the multi-channel audio signals.

In output left and right surround channel signals (Ls, Rs) output through the virtual surround filter unit 200, output gains are changed and time delays occur. The signal correction filter unit 300 may adjust gains and time delays of the left channel signal (L), the center channel signal (C), the low frequency effect channel signal (LFE), and the right channel signal (R) according to output gains and time delays of the left and right surround channel signals (Ls, Rs).

The first addition unit 401 adds left-hand side channel signals output from the virtual surround filter unit 200 and the signal correction filter unit 300, and the second addition unit 402 adds right-hand side channel signals output from the virtual surround filter unit 200 and the signal correction filter unit 300. Then, the added left-hand side signals are output to the left channel speaker 500, and the added right-hand side signals are output to the right channel speaker 600.

As described above, if the input signals are 6.1 channel audio signals, a rear surround channel is included with the 5.1 channels. In this case, another virtual surround filter identical to the virtual surround filter unit 200 can be included in the stereo sound generation apparatus, and a rear surround channel audio signal may be divided into two parts and input to the additional virtual surround filter.

If the input signals are 7.1 channel audio signals, two rear surround channels are included with the 5.1 channels. In this case, another virtual surround filter identical to the virtual surround filter unit 200 can be included in the apparatus and the two rear surround channel audio signals are input to the additional virtual surround filter.

Figure 3:
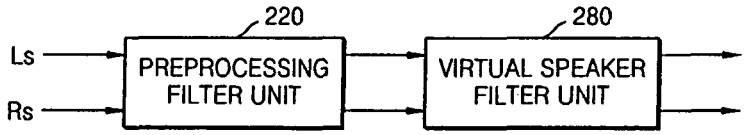
FIG. 3 is a schematic diagram illustrating a virtual surround filter unit of the stereo sound generation apparatus of FIG. 2 according to an embodiment of the present general inventive concept.

FIG. 3 is a schematic diagram illustrating the virtual surround filter unit 200 (not labeled in FIG. 3) of the stereo sound generation apparatus of FIG. 2 according to an embodiment of the present general inventive concept.

The virtual surround filter unit 200 includes a preprocessing filter unit 220 and a virtual speaker filter unit 280.

The preprocessing filter unit 220 reduces a correlation between an input left surround channel signal (Ls) and an input right surround channel signal (Rs) so that localization of the surround channel sound and the actual perception can be improved.

When the correlation between the left and right surround channel signals Ls and Rs is high, a sound image is not generated at the left and right rear sides of the listener, but is instead generated at the center rear of the listener as a phantom sound image. Also, due to front/rear confusion, the sound image may sound as though originating at the front side of the listener, thereby making it difficult to perceive a surround effect.

Accordingly, the preprocessing filter unit 220 reduces the correlation between the left and right surround channel signals (Ls, Rs), and generates a presence perception so that a natural surround channel effect can be generated. The preprocessing filter unit 220 will be explained in more detail with reference to FIGS. 4 and 5.

The virtual speaker filter unit 280 receives signals output from the preprocessing filter unit 220, and disposes virtual sound sources at the left rear and right rear of the listener such that a stereo perception can be generated. The virtual speaker filter unit 280 will be explained in more detail with reference to FIGS. 6 and 7.

Figure 4:
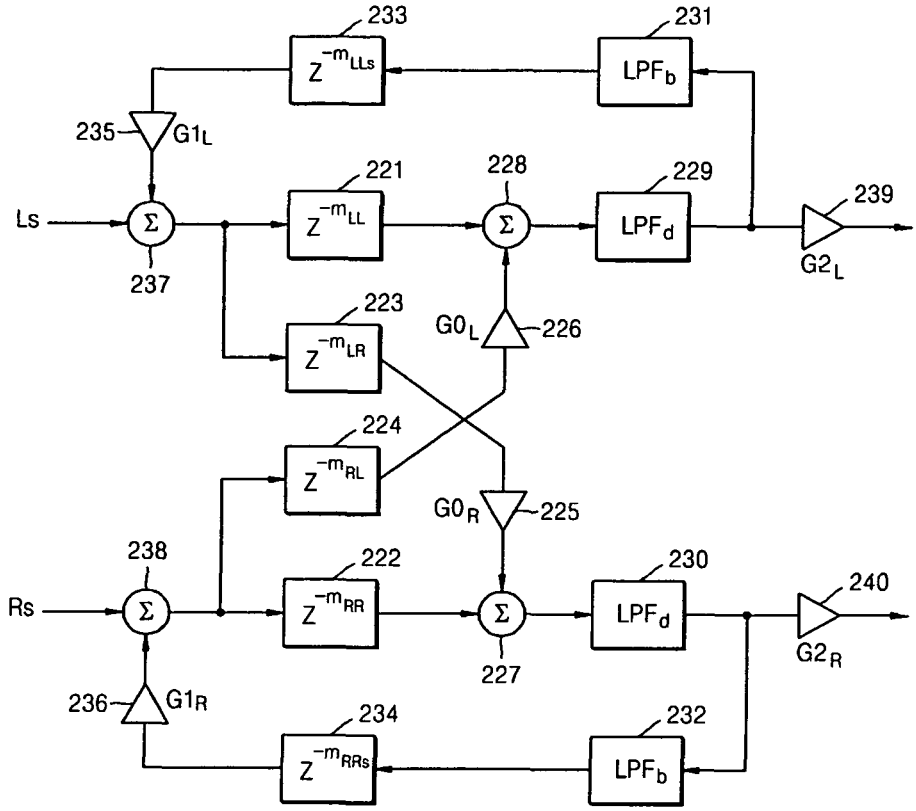
FIG. 4 is a diagram illustrating a preprocessing filter unit of the virtual surround filter unit of FIG. 3 according to an embodiment of the present general inventive concept.

FIG. 4 is a diagram illustrating the preprocessing filter unit 220 (not labeled in FIG. 4) of the virtual surround filter unit of FIG. 3 (i.e., reference 200 in FIG. 2) according to an embodiment of the present general inventive concept.

The preprocessing filter unit 220 is implemented by using a plurality of delay units, a plurality of gain units, and a plurality of addition units that are asymmetrical to each other.

That is, the preprocessing filter unit 220 includes a first delay unit 221, a second delay unit 222, a third delay unit 223, a fourth delay unit 224, a first gain unit 225, a second gain unit 226, a first addition unit 227, a second addition unit 228, a first filter 229, a second filter 230, a third filter 231, a fourth filter 232, a fifth delay unit 233, a sixth delay unit 234, a third gain unit 235, a fourth gain unit 236, a third addition unit 237, and a fourth addition unit 238. The preprocessing filter unit 220 may also include a fifth gain unit 239 and a sixth gain unit 240.

The first delay unit 221 delays the left surround channel signal Ls for a predetermined time (i.e., a first predetermined time). In the present embodiment, the first delay unit 221 may be implemented by a delay filter having a transfer function that is $Z^{-mLL}$.

The second delay unit 222 delays the right surround channel signal Rs for a predetermined time (i.e., a second predetermined time). In the present embodiment, the second delay unit 222 may be implemented by a delay filter having a transfer function that is $Z^{-mRR}$ .

The first delay unit 221 and the second delay unit 222 are asymmetrical to each other, that is, the predetermined delay times are different from each other. In other words, the first predetermined time is different than the second predetermined time.

The third delay unit 223 delays the left surround channel signal Ls for a predetermined time (i.e., a third predetermined time). In the present embodiment, the third delay unit 223 may be implemented by a delay filter having a $Z^{-mLR}$ transfer function.

The fourth delay unit 224 delays the right surround channel signal Rs for a predetermined time (i.e., a fourth predetermined time). In the present embodiment, the fourth delay unit 224 may be implemented by a delay filter having a $Z^{-mRL}$ transfer function.

The third delay unit 223 and the fourth delay unit 224 are asymmetrical to each other, that is, the predetermined delay times are different from each other. In other words, the third predetermined time is different than the fourth predetermined time.

The first gain unit 225 changes an output gain of the third delay unit 223, and the second gain unit 226 changes an output gain of the fourth delay unit 224.

The second addition unit 228 adds the outputs of the first delay unit 221 and the second gain unit 226. The first addition unit 227 adds the outputs of the second delay unit 222 and the first gain unit 225.

Here, the first gain unit 225 and the second gain unit 226 reduce the output gains of the delayed left surround channel signal Ls and the delayed right surround channel signal Rs, respectively, by predetermined magnitudes. These first and second gain units 225 and 226 prevent mixing of the audio signals of the two channels.

The first filter 229 filters the output signal of the second addition unit 228, and the second filter 230 filters the output signal of the first addition unit 227. The output signals of the first and second filters 229 and 230 are input to the virtual speaker filter unit 280 (see FIG. 3). As mentioned above, the output signals of the first and second filters 229 and 230 may be gain adjusted (e.g., amplified) by the fifth and sixth gain units 239 and 240, respectively. However, the fifth and sixth gain units 239 and 240 need not necessarily be included in the preprocessing unit 220. The output signals of the first and second filters 229 and 230 or the fifth and sixth gain units 239 and 240 have a reduced correlation therebetween.

The fifth delay unit 233 delays the output signals of the first and third filters 229 and 231 for a predetermined time (i.e., a fifth predetermined time). In the present embodiment, the fifth delay unit 233 may be implemented by a delay filter having a $Z^{-}$mLLs transfer function.

The sixth delay unit 234 delays the output signals of the second and fourth filters 230 and 232 for a predetermined time (i.e., a sixth predetermined time). In the present embodiment, the sixth delay unit 234 may be implemented by a delay filter having a transfer function that is $Z^{-mRRs}$. The fifth delay unit 233 and the sixth delay unit 234 are asymmetrical to each other, that is, the predetermined delay times are different from each other. In other words, the fifth and sixth predetermined times are different from each other.

According to the present embodiment of the general inventive concept, the first through fourth filters 229 through 232 may be low pass filters.

The third gain unit 235 changes the output gain of the fifth delay unit 233 and the fourth gain unit 236 changes the output gain of the sixth delay unit 234.

The third addition unit 237 adds the output signal of the third gain unit 235 and the left surround channel signal (Ls), and the fourth addition unit 238 adds the output signal of the fourth gain unit 236 and the right surround channel signal (Rs).

Figure 5:
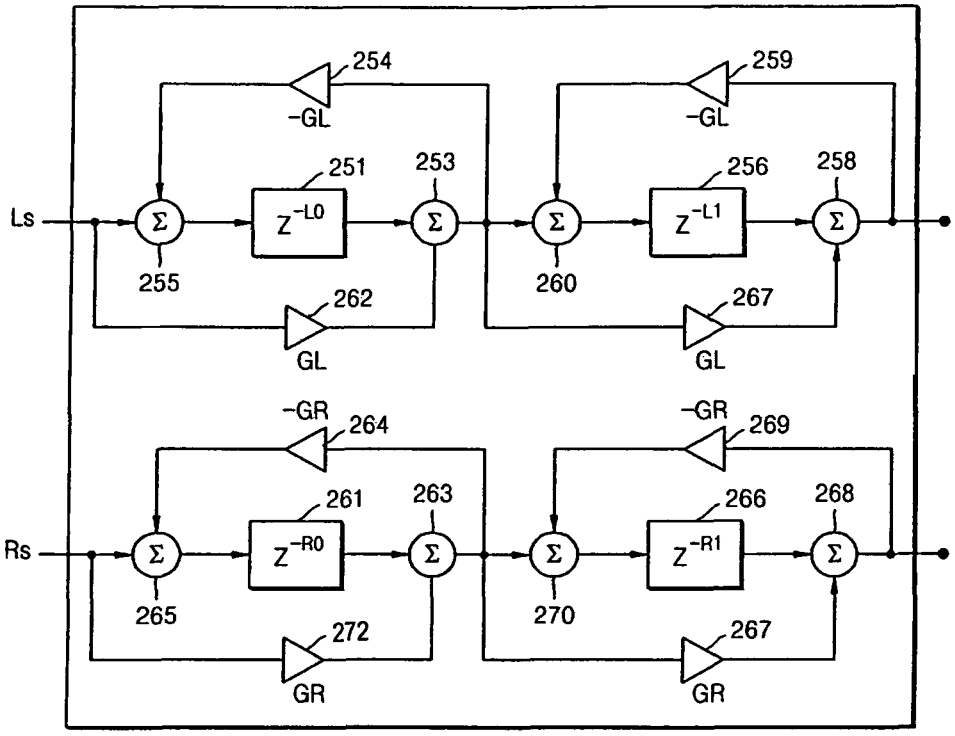
FIG. 5 is a diagram illustrating a preprocessing filter unit of the virtual surround filter unit of FIG. 3 according to another embodiment of the present general inventive concept.

FIG. 5 is a diagram illustrating the preprocessing filter unit 220 of the virtual surround filter unit of FIG. 3 (i.e., reference 200 in FIG. 2) according to another embodiment of the present general inventive concept.

The preprocessing filter unit 220 of FIG. 5 has similar characteristics to those of the preprocessing filter unit 220 of FIG. 4. However, the preprocessing filter unit 220 of FIG. 5 can generate a more natural wide stereo effect by using a full-band filter applied to an artificial reverberator in order to artificially reproduce the reverberation characteristic of space. Also, the full-band filter has a characteristic of delaying a predetermined frequency component, and by applying this characteristic, generating a stereo effect with respect to a mono signal is enabled.

In the preprocessing filter unit 220 illustrated in FIG. 5, each of the left surround channel signal (Ls) and the right surround channel signal (Rs) are applied to two full band filters. That is, the left surround channel signal (Ls) is converted into a plurality of reverberation sounds through two left full-band filters connected in series. Also, the right surround channel signal (Rs) is converted into a plurality of reverberation sounds through two right full-band filters connected in series. Thus, a correlation between the left surround channel signal Ls and the right surround channel signal Rs can be reduced using the reverberation sound.

First, a process of full-band filtering the left surround channel signal (Ls) will now be explained. In the left full-band filters, first through fourth adders 255, 253, 260, and 258 are connected to input terminals and output terminals of first and second delay units 251 and 256, respectively. An input signal is fed forward to the second and fourth adders 253 and 258 formed with attenuation coefficients (GL) through first and third multipliers 262 and 267, respectively. An addition output of the second and fourth adders 253 and 258 are respectively fed back to the first and third adders 255 and 260 through second and fourth multipliers 254 and 259 formed with attenuation coefficients (−GL).

The structure of the two right full-band filters may be the same as that of the two left full-band filters of the left surround channel signal Ls. For illustration purposes, the two right full-band filters are disposed under the two left full-band filters in FIG. 5. The two right full-band filters may include fifth through eighth adders 265, 263, 270, and 268, third and fourth delay units 261 and 266, fifth through eighth multipliers 272, 264, 267, and 269.

Here, when the input signal is a mono signal, in order to make the mono signal a stereo signal, the delay values of the four delay units 251, 256, 261, and 266 are set differently to L0, L1, R0, and R1, respectively. The delay values of two delay units connected in series in each channel have relationships of L0>L1, R0>R1, or L0<L1, R0<R1. This is to maximize the reduction of the correlation by asymmetry as in the preprocessing filter unit 220 of FIG. 4 described above.

Also, the gain values of the multipliers of filters may have identical values, and when necessary, can be set differently. For example, as illustrated in FIG. 5, the first multiplier 262 and the second multiplier 254 may have the values GL and −GL, respectively. Also, in order to prevent an out-of-phase phenomenon, the attenuation coefficients (GL and GR) may have identical signs or opposite signs, but the gains of two filters connected dependently are made to have identical signs.

Figure 6:
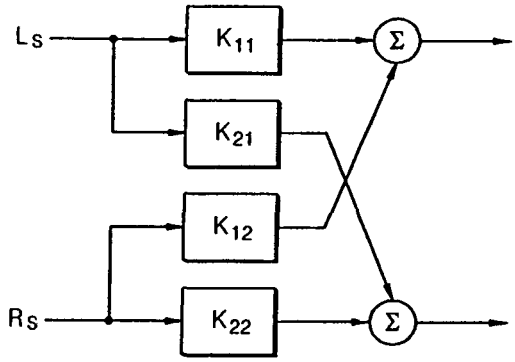
FIG. 6 is a detailed diagram illustrating a virtual speaker filter unit of the virtual surround filter unit of FIG. 3 according to an embodiment of the present general inventive concept.

FIG. 6 is a detailed diagram illustrating the virtual speaker filter unit 280 of the virtual surround filter unit of FIG. 3 (i.e., reference 280 in FIG. 2) according to an embodiment of the present general inventive concept.

The virtual speaker filter unit 280 illustrated in FIG. 6 converts the left and right surround channel signals (Ls, Rs) output from the preprocessing filter unit 220 described above with reference to FIGS. 4 and 5, into virtual sound sources at the left rear and right rear, respectively, of the listener.

The virtual speaker filter unit 280 has a structure in which the left and right surround channel signals (Ls, Rs) output from the preprocessing filter unit 220 are convoluted and added by four finite impulse response (FIR) filters $K_{11}$, $K_{12}$, $K_{21}$, and $K_{22}$.

The left surround channel signal (Ls) is convoluted with the FIR filter $K_{11}$, and the right surround channel signal (Rs) is convoluted with the FIR filter $K_{12}$. The two convoluted signals are then added and generated as a left channel output signal. The left surround channel signal (Ls) is also convoluted with the FIR filter $K_{21}$ and the right surround channel signal (Rs) is also convoluted with the FIR filter $K_{22}$. These two convoluted signals are added and generated as a right channel output signal. These left and right channel output signals are added to the output signals, respectively, of the signal correction filter unit 300 (see FIG. 1) to be explained later, and final output signals of two channels are generated.

Figure 7:
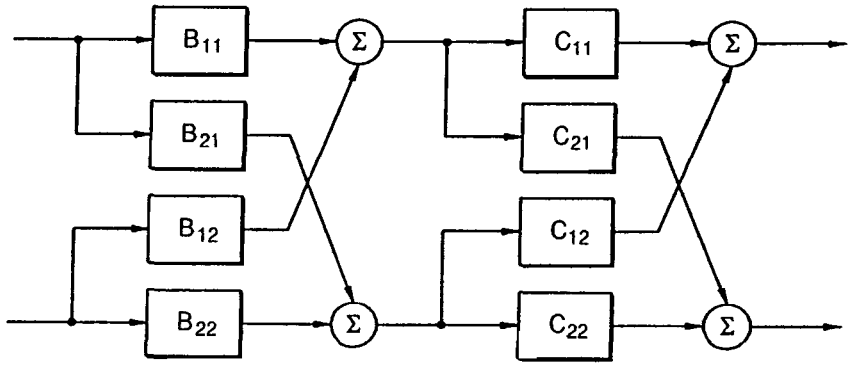
FIG. 7 is a design block diagram illustrating the virtual speaker filter unit of FIG. 6 according to an embodiment of the present general inventive concept.

FIG. 7 is a design block diagram illustrating the virtual speaker filter unit 280 of FIG. 6 according to an embodiment of the present general inventive concept.

First, the virtual speaker filter unit 280 includes a binaural synthesis filter $B_{11}$, $B_{12}$, $B_{21}$, and $B_{22}$, implemented as a head related transfer function (HRTF) matrix between a virtual sound source and a virtual listener, and a crosstalk canceling filter $C_{11}$, $C_{12}$, $C_{21}$, and $C_{22}$, implemented as an inverse matrix of the HRTF matrix between the virtual listener and two channel output positions.

The binaural synthesis filter $B_{11}$, $B_{12}$, $B_{21}$, and $B_{22}$ is designed as follows. The binaural synthesis filter $B_{11}$, $B_{12}$, $B_{21}$, and $B_{22}$ is implemented by using an HRTF that is an acoustic transfer function between a sound source and eardrums of the virtual listener (or actual listener).

The HRTF contains information indicating the characteristic of a space through which a sound is transmitted including the inter-aural level difference (ILD), the inter-aural time difference (ITD), and the shape of the pinna of the listener. In particular, the HRTF includes information about the pinna that has a critical influence on above and below sound localization. Since modeling of a pinna with a complicated shape is not easy, the HRTF is usually obtained through measurement using a dummy head. A surround speaker is usually disposed between 90 degrees and 110 degrees with respect to a front center of the dummy head. Accordingly, in order to localize a virtual speaker between 90 degrees and 110 degrees, an HRTF is measured between 90 degrees and 110 degrees to the left and to the right of the front center of the dummy head.

It is assumed that HRTFs corresponding to paths between a sound source positioned between 90 degrees and 110 degrees to the left of the dummy head and the left ear and right ear of the dummy head are $B_{11}$, and $B_{21}$, respectively, and HRTFs corresponding to paths between a sound source positioned between 90 degrees and 110 degrees to the right of the dummy head and the left ear and right ear of the dummy head are $B_{12}$ and $B_{22}$, respectively, If the binaural synthesized output signal is output through a headphone, the listener perceives the sound image is generated between 90 degrees and 110 degrees to the left and to the right of the front center. The binaural synthesis shows the best performance when the signal is reproduced through a headphone.

However, if the signal is reproduced through two speakers, crosstalk between the two speakers and the two ears occur such that localization performance is degraded. That is, although the left channel sound should only be heard in the left ear and the right channel sound should only be heard in the right ear, a crosstalk phenomenon between the two channels occurs. As a result, the left channel sound is heard also in the right ear and the right channel sound is heard also in the left ear. Thus, the sense of localization is degraded such that a sound image is not positioned on an exact spot.

Accordingly, the crosstalk canceling filter unit $C_{11}$, $C_{12}$, $C_{21}$, and $C_{22}$ is designed to cancel the crosstalk. For this design, the HRTF between the listener (which corresponds to the virtual listener) and the two speakers should be measured.

Assuming that HRTFs between a speaker disposed at a predetermined position to the left of the listener (which can be measured by the dummy head) and the left ear and right ear of the dummy head are $H_{11}$, and $H_{21}$, respectively, and HRTFs between a speaker disposed at a predetermined position to the right of the dummy head and the left ear and right ear of the dummy head are $H_{12}$ and $H_{22}$, respectively, a crosstalk canceling filter matrix (C(z)) is designed as an inverse matrix of the HRTF, as the following equation 1:

$$\begin{bmatrix} C_{11}(z) & C_{12}(z) \\ C_{21}(z) & C_{22}(z) \end{bmatrix} = \begin{bmatrix} H_{11}(z) & H_{12}(z) \\ H_{21}(z) & H_{22}(z) \end{bmatrix}^{-1} \quad (1)$$

The binaural synthesis filter matrix localizes virtual speakers at the positions of left and right surround speakers. The crosstalk canceling filter matrix cancels the crosstalk between the two speakers (i.e., the virtual speakers) and the two ears of the listener. Accordingly, the matrix K(z) of the virtual speaker filter unit 280 is calculated by multiplying two filter matrixes as the following equation 2:

$$\begin{bmatrix} K_{11}(z) & K_{12}(z) \\ K_{21}(z) & K_{22}(z) \end{bmatrix} = \begin{bmatrix} C_{11}(z) & C_{12}(z) \\ C_{21}(z) & C_{22}(z) \end{bmatrix} \begin{bmatrix} B_{11}(z) & B_{12}(z) \\ B_{21}(z) & B_{22}(z) \end{bmatrix} \quad (2)$$

As can be seen in FIG. 6, the virtual speaker filter unit 280 includes four filters and performs a convolution operation four times. Accordingly, the virtual speaker filter unit 280 requires a large amount of computation when the order of the filter is high.

A current trend in digital media products is to include mounted stereo speaker systems. In portable devices, such as portable media players (PMPs) and personal digital assistants (PDAs), as well as televisions, two speakers are disposed close to each other.

Accordingly, when the two speakers are disposed closer to each other than a distance to a listener, $K_{11}$,(z) and $K_{12}$(z) have a high correlation due to a crosstalk canceling characteristic and $K_{21}$(z) and $K_{22}$(z) also have a high correlation.

Accordingly, when the two speakers are disposed asymmetrically about the listener, virtual speaker filter coefficients can be assumed as the following expression 3:

$$K_{12}(z) \cong \alpha_1 z^{-\beta_1} K_{11}(z),\ K_{21}(z) \cong \alpha_2 z^{-\beta_2} K_{22}(z) \quad (3)$$

Here, a gain value ($\alpha$) is a level difference between two HRTFs, and a delay value ($\beta$) is a delay difference between two HRTFs. The level difference ($\alpha$) between two HRTFs is obtained from a difference between maximum values of impulse responses of the two HRTFs between the speakers and the two ears of the listener, or the difference between root mean square (RMS) values. The delay difference ($\beta$) between two HRTFs is obtained from a time when a cross-correlation function of impulse responses of the two HRTFs between the speakers and two ears becomes a maximum. In another embodiment, the gain value ($\alpha$) may be determined by a difference between maximum values of impulse responses with respect to two filters of a lattice structure designed in advance, and the delay value ($\beta$) may be determined as a time when the cross-correlation function of impulse responses with respect to the two filters of a lattice structure designed in advance becomes a maximum.

Figure 8:
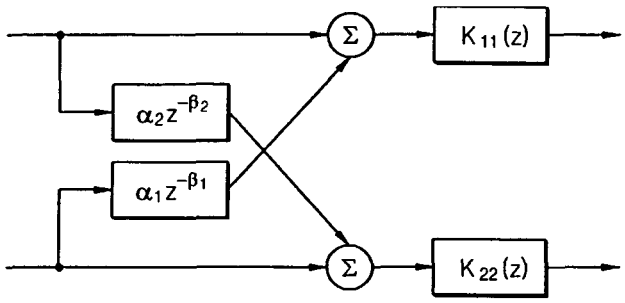
FIG. 8 is an approximated design block diagram illustrating the virtual speaker filter unit of FIG. 6 according to an embodiment of the present general inventive concept.

The virtual speaker filter unit 280 (see FIG. 3) can be expressed as the block diagram of FIG. 8 when equation 3 is used. Additionally, the block diagram of FIG. 8 can be expressed again as the block diagram of FIG. 9.

Figure 9:
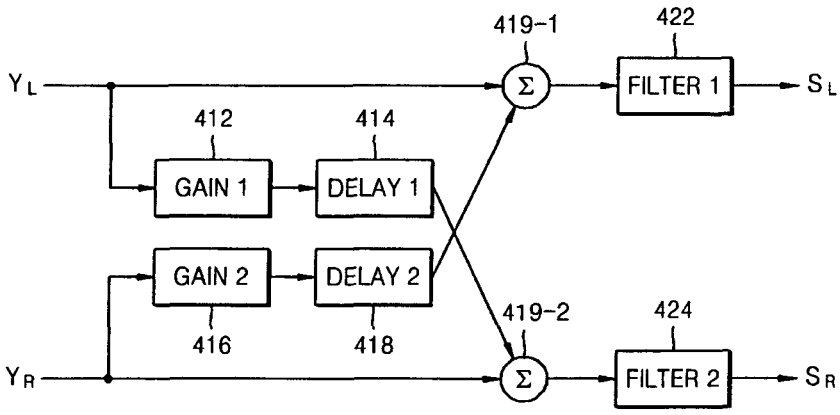
FIG. 9 is a block diagram illustrating the virtual speaker filter unit of FIG. 6 according to an embodiment of the present general inventive concept.

FIG. 9 is a block diagram illustrating the virtual speaker filter unit 280 (see FIG. 3) of FIG. 6 according to an embodiment of the present general inventive concept. Referring to FIG. 9, a first gain unit 412 adjusts a gain of a left channel signal ($Y_L$) being input with a first predetermined gain value.

A second gain unit 416 adjusts a gain of a right channel signal ($Y_R$) being input with a second predetermined gain value.

A first delay unit 414 delays the left channel signal ($Y_L$) gain-adjusted in the first gain unit 412 with a first predetermined delay value.

A second delay unit 418 delays the right channel signal ($Y_R$) gain-adjusted in the second gain unit 416 with a second predetermined delay value.

A first addition unit 419-1 adds the left channel signal ($Y_L$) being input and the right channel signal ($Y_R$) gain- and delay-adjusted through the second gain unit 416 and the second delay unit 418.

A second addition unit 419-2 adds the right channel signal ($Y_R$) being input and the left channel signal ($Y_L$) gain- and delay-adjusted through the first gain unit 412 and the first delay unit 414.

A first filter unit 422 has an inverse HRTF form of an HRTF that is an acoustic transfer function between speakers and two ears of a listener, and adjusts the frequency characteristic of a signal mixed in the first addition unit 419-1. An output signal ($S_L$) of the first filter unit 422 is output to a left speaker.

A second filter unit 424 has an inverse HRTF form of an HRTF that is an acoustic transfer function between the speakers and the two ears of the listener, and adjusts the frequency characteristic of a signal mixed in the second addition unit 419-2. An output signal ($S_R$) of the second filter unit 424 is output to a right speaker.

Accordingly, the virtual speakerfilter unit 280 of FIG. 9 includes the two gain units 412 and 416, the two delay units 414 and 418, and the two filters 422 and 424.

As a result, while convolution is performed four times with respect to the four filters in the structure of the virtual speaker filter unit 280 of FIGS. 6 and 7, convolution is performed only twice with respect to the two filters in the virtual speaker filter unit 280 of the present embodiment of FIGS. 8 and 9 such that an amount of computation and the size of a memory can be reduced.

Additionally, when the two speakers are disposed symmetrically about the listener, the virtual speaker filter matrix becomes $K_{11}(z)=K_{22}(z)$ and $K_{21}(z)=K_{12}(z)$. Accordingly, the virtual speaker filter matrix can be expressed as the following expression 4:

$$K_2(z)\approx\alpha z^{-\beta}K_1(z) \tag{4}$$

Figure 10:
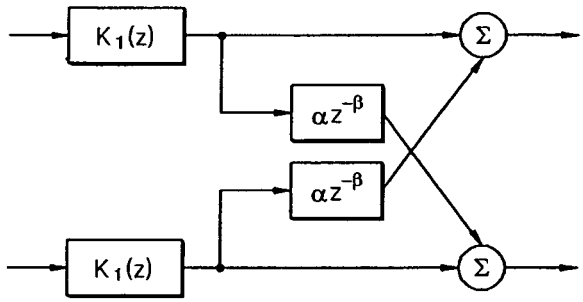
FIG. 10 is an approximated diagram illustrating the virtual speaker filter unit of FIG. 6 according to another embodiment of the present general inventive concept.
Figure 11:
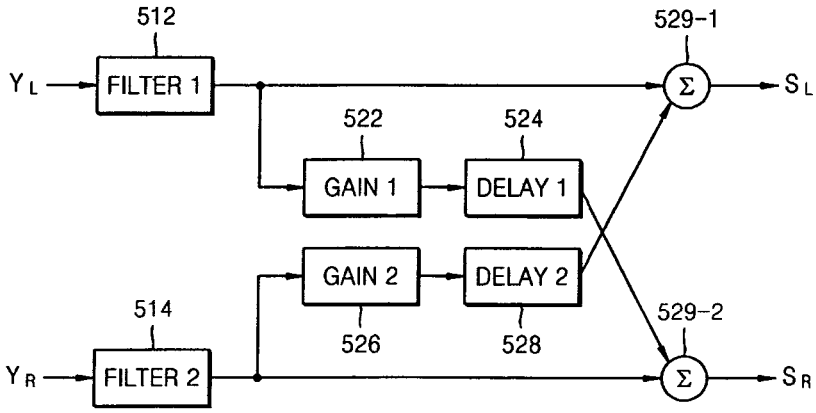
FIG. 11 is a block diagram illustrating the virtual speaker filter unit of FIG. 6 according to another embodiment of the present general inventive concept.

By using expression 4, the virtual speaker matrix can be expressed as the block diagram illustrated in FIG. 10. FIG. 10 is an approximated diagram illustrating the virtual speaker filter unit 280 (see FIG. 3) of FIG. 6 according to another embodiment of the present general inventive concept. The gain value ($\alpha$) and the delay value ($\beta$) are calculated in the same manner as in the virtual speaker filter unit 280 of FIG. 9. The block diagram of FIG. 10 can be expressed again as the block diagram of FIG. 11. FIG. 11 is a block diagram illustrating the virtual speaker filter unit 280 (see FIG. 3) of FIG. 6 according to another embodiment of the present general inventive concept Referring to FIG. 11, first and second filter units 512 and 514 adjust frequency characteristics of the input left and right channel signals, respectively.

First and second gain units 522 and 526 adjust gains of the output signals of the first and second filter units 512 and 514, respectively, with predetermined gain values.

First and second delay units 524 and 528 delay the signals gain-adjusted in the first and second gain units 522 and 526, respectively, with predetermined delay values.

A first addition unit 529-1 adds the output signal of the first filter unit 512 and the gain-and delay-adjusted output signal of the second delay unit 528.

A second addition unit 529-2 adds the output signal of the second filter unit 514 and the gain- and delay-adjusted output signal of the first delay unit 524.

Figure 12:
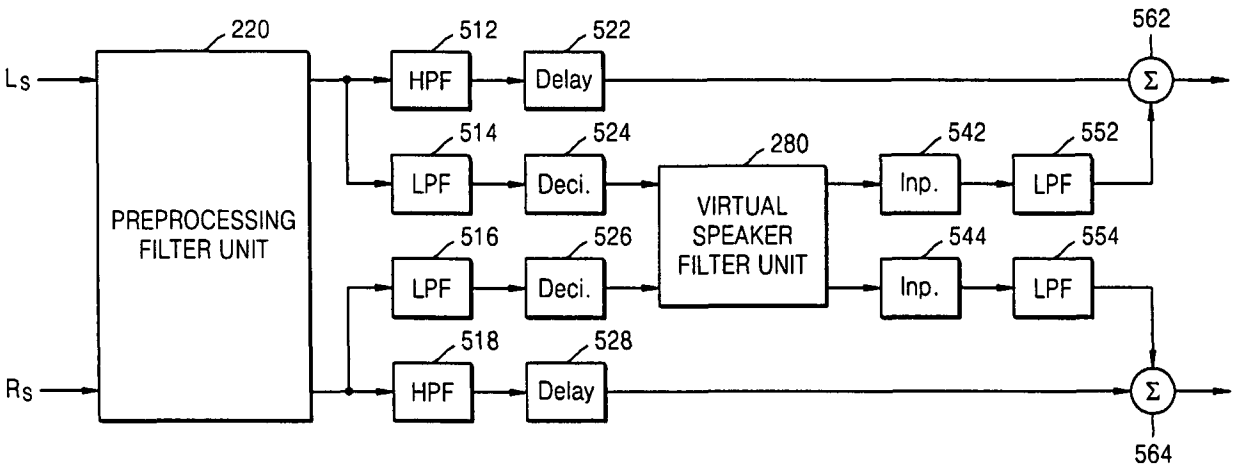
FIG. 12 is a block diagram illustrating the virtual surround filter unit of the stereo sound generation apparatus of FIG. 2 according to another embodiment of the present general inventive concept.
Figure 13:
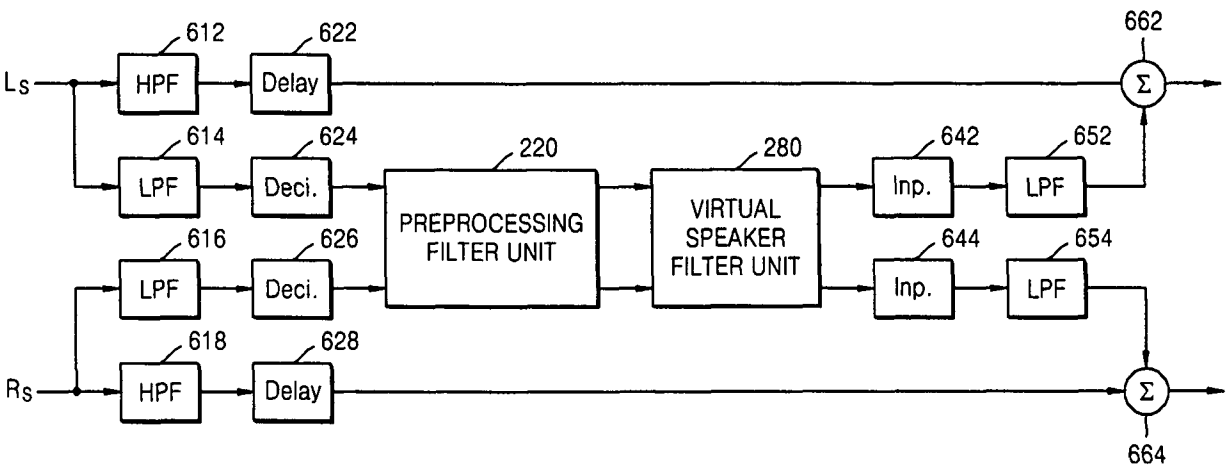
FIG. 13 is a block diagram illustrating the virtual surround filter unit of the stereo sound generation apparatus of FIG. 2 according to another embodiment of the present general inventive concept.

FIGS. 12 and 13 illustrate other embodiments of the virtual surround filter unit 200 of FIG. 2.

Generally, a frequency band having an influence on the localization of a virtual sound source is a low frequency band. Also, in a high frequency band with a very short wavelength, the performance of a crosstalk canceling filter is degraded and a crosstalk component cannot be removed. Accordingly, in the virtual surround filter unit 200 of FIG. 2, signal processing of only a low frequency band is performed as follows. That is, an input signal is divided into two frequency bands by using a low pass filter and a high pass filter. A high frequency signal passing through the high pass filter is not signal-processed and the signal passing through the low pass filter is decimated. A sampling frequency of the decimated signal is reduced. Accordingly, delay filter coefficients of the preprocessing filter unit 220 are reduced, and an FIR order of the virtual speaker filter unit 280 is reduced such that an amount of computation of the virtual surround filter 200 and the memory can be greatly reduced.

FIG. 12 is a block diagram illustrating the virtual surround filter unit 200 of FIG. 2 according to another embodiment of the present general inventive concept. Referring to FIG. 12, first and second channel signals (Ls, Rs) pass through the preprocessing filter unit 220 to reduce a correlation and to generate a presence perception. Each of the preprocessing-filtered first and second channel signals is divided into a high frequency band and a low frequency band through high pass filters (HPF) 512 and 518 and low pass filters (LPF) 514 and 516. At this time, low frequency band signals output through the two LPFs 514 and 516 are decimated by decimation units 524 and 526, respectively, such that sampling frequencies are reduced. Also, high frequency band signals output through the two HPFs 512 and 518 are delayed for a predetermined time by delay units 522 and 528, respectively, in order to synchronize the high frequency band signals with the paths of the low frequency band signals. Accordingly, each decimated signal is output as two-channel virtual sound sources at predetermined positions through the virtual speaker filter unit 280. Here, the decimated signals reduce the FIR filter orders of the virtual speaker filter unit 280 due to the low sampling frequencies. The two-channel signals output from the virtual speaker filter unit 280 are used for interpolation through interpolators 542 and 544. Here, the interpolators 542 and 544 adjust the sampling frequencies, which are reduced by the decimation, to original sampling frequencies. The interpolated signals are then low-pass filtered through LPFs 552 and 554.

Finally, first and second adders 562 and 564 add the low-pass filtered first and second channel signals output from the LPFs 552 and 554, respectively, and the high frequency first and second channel signals output from the HPFs 512 and 518 and delayed in the delay units 522 and 528, respectively.

Here, the preprocessing filter unit 220 performs filtering of full-band signals.

Accordingly, a spatial perception is generated with respect to the full-band signals. Also, since a virtual sound source is localized with respect to only a low frequency band signal, multi-rate processing that processes only the low frequency band signal can be applied to the virtual speaker filter unit 280.

The preprocessing filter unit 220 may be implemented using any one of the embodiments of FIGS. 4 and 5, and the virtual speaker filter unit 280 may be implemented using any one of the embodiments of FIGS. 6, 9, and 11.

FIG. 13 is a block diagram illustrating the virtual surround filter unit 200 of FIG. 2 according to another embodiment of the present general inventive concept. Referring to FIG. 13, first and second channel signals are divided into high frequency band signals and low frequency band signals by HPFs 612 and 618 and LPFs 614 and 616, respectively. Each of the low frequency band signals output through the two LPFs 614 and 616 are decimated by decimation units 624 and 626, respectively. Also, the high frequency band signals output by the two HPFs 612 and 618 are delayed for a predetermined time in order to synchronize the high frequency band signals with the paths of the low frequency band signals. In the decimated signals, the correlation is reduced through the preprocessing filter unit 220 and the virtual speaker filter unit 280, and the low frequency band signals are output as two channels signals converted into virtual sound sources with predetermined positions.

The two-channel signals output from the virtual speaker filter unit 280 are interpolated by interpolators 642 and 644. The interpolated signals are low-pass filtered by LPFs 652 and 654.

Finally, first and second adders 662 and 664 add the low-pass filtered first and second channel signals, and the high frequency first and second channel signals output from the HPFs 612 and 618 and delayed in delay units 622 and 628.

The preprocessing filter unit 220 may be implemented using any one of the embodiments of FIGS. 4 and 5, and the virtual speaker filter unit 280 may be implemented using any one of the embodiments of FIGS. 6, 9, and 11.

Figure 14:
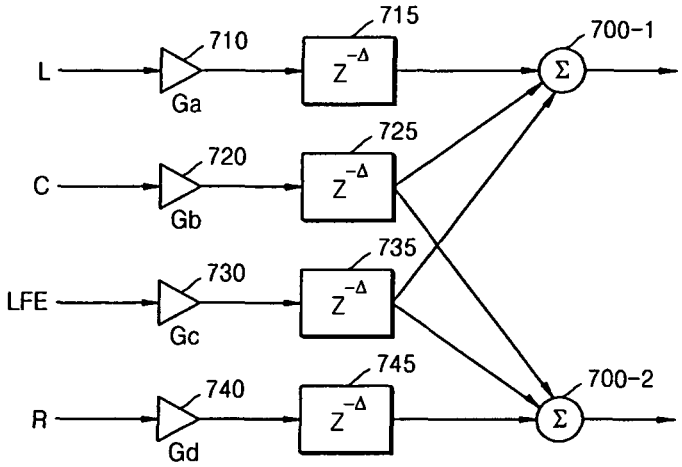
FIG. 14 is a detailed block diagram illustrating a signal correction filter unit of the stereo sound generation apparatus of FIG. 2 according to an embodiment of the present general inventive concept.

FIG. 14 is a detailed block diagram illustrating the signal correction filter unit 300 of FIG. 2 according to an embodiment of the present general inventive concept.

The signal correction filter unit 300 of FIG. 14 includes gain units 710, 720, 730, and 740 with predetermined gain values (Ga, Gb, Gc, Gd), and delay units 715, 725, 735, and 745 with predetermined delay values ($Z^{-\Delta}$).

An output gain of a left channel signal (L) is changed by the gain unit 710, and the left channel signal (L) is delayed by the delay unit 715.

An output gain of a center channel signal (C) is changed by the gain unit 720, and the center channel signal (C) is delayed by the delay unit 725.

An output gain of a LFE channel signal (LFE) is changed by the gain unit 730, and the LFE channel signal (LFE) is delayed by the delay unit 735.

An output gain of a right channel signal (R) is changed by the gain unit 740, and the right channel signal (R) is delayed by the delay unit 745.

A first addition unit 700-1 adds signals output from the delay units 715, 725, and 735.

A second addition unit 700-2 adds signals output from the delay units 725, 735, and 745.

If the left and right surround channel signals pass through the virtual surround filter unit 200, the output gains and time delays of the left and right surround channel signals change from those of the original signals input to the stereo sound generation apparatus of FIG. 2. Accordingly, based on a characteristic of the virtual surround filter unit 200, the output gains and time delays of the left channel (L), center channel (C), LFE channel (LFE), and right channel (R) signals are adjusted. Here, being "based on the characteristic of the virtual surround filter" does not mean that the changes in the output gains and time delays of the left and right surround channel signals are determined by the change in the input signal. Instead, this means that the changes in the output gains and time delays induced by the signal correction filter unit 300 are determined by elements of the virtual surround filter unit 200.

Here, the gain values (Ga, Gb, Gc, Gd) of the gain units 710, 720, 730, and 740 are determined by comparing RMS values of the input signal and the output signal of the virtual surround filter unit 200. The delay values ($Z^{-\Delta}$) of the delay units 715, 725, 735, and 745 are obtained by using impulse responses of the virtual surround filter unit 200, or by using group delays. For example, the time delay value may be determined based on the group delay of the FIR filter ($K_{11}$) of the previous embodiments.

Figure 15:
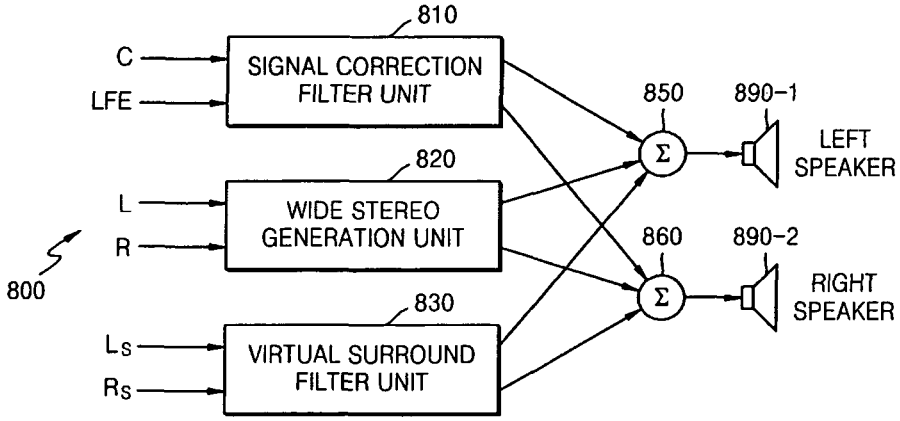
FIG. 15 is a block diagram illustrating a stereo sound generation apparatus to reproduce multi-channel audio signals through two channels according to another embodiment of the present general inventive concept.

FIG. 15 is a block diagram illustrating a stereo sound generation apparatus to reproduce multi-channel audio signals through two channels according to another embodiment of the present general inventive concept.

The stereo sound generation apparatus illustrated in FIG. 15 includes multi-channel audio input signals 800, a signal correction filter unit 810, a wide stereo generation unit 820, a virtual surround filter unit 830, first and second addition units 850 and 860, a left channel speaker 890-1, and a right channel speaker 890-2.

The multi-channel audio signals 800 include a left channel signal (L), a center channel signal (C), a low-frequency effect channel signal (LFE), a right channel signal (R), a left surround channel signal (Ls), and a right surround channel signal (Rs).

The virtual surround filter unit 830 may be similar to the virtual surround filter unit 200 of FIG. 2.

The wide stereo generation unit 820 receives inputs of the left and right channel signals (L, R) and generates widening stereo signals. The wide stereo generation unit 820 includes a widening filter to perform a convolution of left/right binaural synthesis and a crosstalk canceller, and a panorama filter to perform convolution of the widening filter and left/right direct filters. The widening filter generates the left and right channel signals (L, R) as virtual sound sources at arbitrary positions based on an HRTF measured at a predetermined position, and removes the crosstalk of the virtual sound sources based on a filter coefficient to which the HRTF is applied. The left and right direct filters adjust signal characteristics, such as gains and delays, between a sound source signal of the stereo channels and the crosstalk-removed virtual sound sources.

The signal correction filter unit 810 receives the signals of the center channel (C) and the LFE channel from among the multi-channel audio input signals 800.

Output gains and time delays of the left and right surround channel signals (Ls, Rs) output through the virtual surround filter unit 830 and the left and right channel signals (L, R) output through the wide stereo generation unit 820 are changed thereby. The signal correction filter unit 810 adjusts the gains and time delays of the center channel signal (C) and the LFE channel signal (LFE) according to the output gains and time delays of the left and right surround channel signals (Ls, Rs) output from the virtual surround filter unit 830 and the left and right channel signals (L, R) output from the wide stereo generation unit 820.

The first addition unit 850 adds left channel signals output from the virtual surround filter unit 830, the signal correction filter unit 810, and the wide stereo generation unit 820. The second addition unit 860 adds right channel signals output from the virtual surround filter unit 830, the signal correction filter unit 810, and the wide stereo generation unit 820. Then, the added left signals are output through the left channel speaker 890-1 and the added right signals are output through the right channel speaker 890-2.

Figure 16:
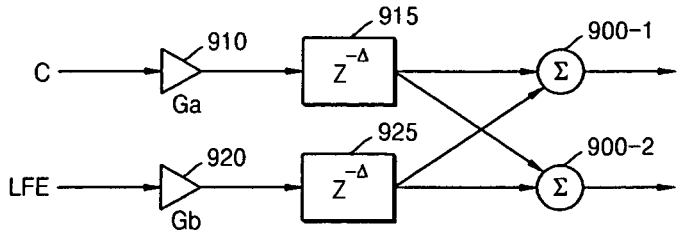
FIG. 16 is a detailed block diagram illustrating a signal correction filter unit of the stereo sound generation apparatus of FIG. 15 according to an embodiment of the present general inventive concept.

FIG. 16 is a detailed block diagram Illustrating the signal correction filter unit 810 of FIG. 15 according to an embodiment of the present general inventive concept.

The signal correction filter unit 810 of FIG. 15 includes gain units 910 and 920 with predetermined gain values (Ga, Gb), and delay units 915 and 925 with predetermined delay values ($Z^{-\Delta}$).

The output gain of the center channel signal (C) is changed by the gain unit 910, and the center channel signal (C) is delayed in the delay unit 915.

The output gain of the LFE channel signal (LFE) is changed by the gain unit 920, and the LFE channel signal (LFE) is delayed in the delay unit 925.

A first addition unit 900-1 adds signals output from the delay units 915 and 925. A second addition unit 900-2 also adds the signals output from the delay units 915 and 925.

Here, the gain values (Ga, Gb) of the gain units 910 and 920 are determined by comparing RMS values of the input signal and the output signal of the virtual surround filter unit 830. The delay values ($Z-\Delta$) of the delay units 915 and 925 are obtained by using the impulse responses of the virtual surround filter unit 830, or by using group delays.

It should be understood that although the embodiments of the present general inventive concept have been described with reference to a listener and two ears of the listener or virtual listener, the apparatuses of the embodiments of the present general inventive concept may be used to produce stereo sound about a listening point of a stereo sound generation system and/or a virtual surround system. The listening point may refer to a position where a listener perceives optimal stereo effect, and this can be approximated using, for example, the dummy head described above. Thus, a listener need not actually be present at the listening point when the apparatuses of the various embodiments operate, as described herein.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present general inventive concept can be easily construed by programmers skilled in the art to which the present general inventive concept pertains.

According to various embodiments of the present general inventive concept as described above, multi-channel audio signals can be reproduced using two-channel outputs, and by using only two-channel outputs, a stereo perception of a multi-channel speaker system can be realized.

Also, in relation to left and right surround channel audio input signals, by generating virtual speakers at a left rear and right rear of a listener, a stereo perception can be effectively provided to the listener.

Furthermore, even when a correlation between the left and right surround channel audio input signals is high, a localization of the sound can be improved, and realistic sound can be generated such that a more improved stereo sound can be provided to the listener.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A stereo sound generation apparatus to reproduce multi-channel audio input signals as two-channel output signals, the apparatus comprising:

a decimation unit configured to decimate low frequency components of two-channel audio input signals from among the multi-channel audio input signals;

a preprocessing filter unit to reduce a correlation between the two-channel audio signals output from the decimation unit and to generate a presence perception;

a virtual speaker filter unit to convert the two-channel audio signals output from the preprocessing filter unit into a virtual sound source at a predetermined position;

a signal correction filter unit to correct a signal characteristic between remaining ones of the multi-channel audio input signals excluding the two-channel audio input signals and the two-channel audio signals output from the virtual speaker filter unit; and an addition unit configured to add signals to be output to a first channel from among the multi-channel audio signals output from the virtual speaker filter unit and the signal correction filter unit, and to add signals to be output to a second channel from among the multi-channel audio signals output from the virtual speaker filter unit and the signal correction filter unit, wherein the preprocessing filter unit comprises:

a first delay unit to delay a first channel audio signal from among the two-channel audio input signals for a first time period;

a second delay unit to delay a second channel audio signal from among the two-channel audio input signals for a second time period;

a third delay unit to delay the first channel audio signal from among the two-channel audio input signals for a third time period;

a fourth delay unit to delay the second channel audio signal from among the two-channel audio input signals for a fourth time period;

a first gain unit to adjust an output gain of the third delay unit;

a second gain unit to adjust an output gain of the fourth delay unit;

a first addition unit to add an output of the first delay unit and an output of the second gain unit; and a second addition unit to add an output of the second delay unit and an output of the first gain unit.

2. The apparatus of claim 1, wherein the preprocessing filter unit comprises:

a first filter to low-pass filter an output signal of the first addition unit;

a second filter to low-pass filter an output signal of the second addition unit;

a fifth delay unit to delay an output signal of the first filter for a fifth time period;

a sixth delay unit to delay an output signal of the second filter for a sixth time period;

a third gain unit to adjust an output gain of the fifth delay unit;

a fourth gain unit to adjust an output gain of the sixth delay unit;

a third addition unit to add the first channel audio signal and an output signal of the third gain unit; and a fourth addition unit to add the second channel audio signal and an output signal of the fourth gain unit.

3. The apparatus of claim 2, wherein the first through sixth time periods are different from each other.

4. The apparatus of claim 1, wherein the virtual speaker filter unit comprises:

a delay unit to delay first and second channel audio input signals with respective predetermined delay values;

a gain unit to adjust an output gain of each of the first and second channel audio input signals delayed in the delay unit;

a first addition unit to add the first channel audio input signal and the gain- and delay-adjusted second channel signal;

a first filter unit to adjust a frequency characteristic of a signal output from the first addition unit;

a second addition unit to add the second channel audio input signal and the gain- and delay-adjusted first channel signal; and a second filter unit to adjust a frequency characteristic of a signal output from the second addition unit.

5. The apparatus of claim 1, wherein the virtual speaker filter unit comprises:

first and second filter units to adjust frequency characteristics of first and second channel signals;

a delay unit to delay output signals of the first and second filter units with respective predetermined delay values;

a gain unit to adjust an output level of each of the signals delayed in the delay unit;

a first addition unit to add an output signal of the first filter unit and a gain- and delay-adjusted output signal of the second filter unit; and a second addition unit to add an output signal of the second filter unit and a gain- and delay-adjusted output signal of the first filter unit.

6. The apparatus of claim 5, wherein a gain of the gain unit is determined by a maximum difference between respective impulse responses in relation to two head related transfer functions (HRTFs) between a speaker and two ears of a listener.

7. The apparatus of claim 5, wherein a delay of the delay unit is determined by a time when a cross-correlation function of impulse responses in relation to two HRTFs between a speaker and two ears of a listener becomes a maximum.

8. The apparatus of claim 5, wherein a gain is determined by a difference between maximum values of impulse responses in relation to two filters of a lattice structure designed in advance.

9. The apparatus of claim 5, wherein a delay is determined by a time when a cross-correlation function of impulse responses in relation to two filters of a lattice structure designed in advance becomes a maximum.

10. The apparatus of claim 1, wherein the signal correction filter unit comprises:

a gain unit to adjust gains of the multi-channel audio input signals excluding the two-channel audio input signals; and a delay unit to delay the multi-channel audio input signals excluding the two-channel audio input signals for a predetermined time.

11. The apparatus of claim 10, wherein a gain of the gain unit is determined by comparing an output signal of the virtual speaker filter unit and the two channel audio input signals.

12. The apparatus of claim 10, wherein a gain of the gain unit is determined by comparing a root mean square (RMS) value of an output signal of the virtual speaker filter unit and RMS values of the two channel audio input signals.

13. The apparatus of claim 10, wherein the predetermined time is determined based on a group delay of a crosstalk canceller.

14. The apparatus of claim 1, wherein the addition unit comprises:

a first addition unit to add signals to be output to a first channel from among the multi-channel audio input signals output from the virtual speaker filter unit and the signal correction filter unit; and a second addition unit to add signals to be output to a second channel from among the multi-channel audio input signals output from the virtual speaker filter unit and the signal correction filter unit.

15. A stereo sound generation apparatus, comprising:

a first filter unit to receive surround audio signals from among at least five input audio signals and to generate virtual sound sources at predetermined locations with respect to a listening point;

a second filter unit to receive remaining audio signals from among the at least five input audio signals and to compensate for a delay and gain difference induced in the surround audio signals by the first filter unit; and an output unit configured to combine first selected ones of the surround audio signals and the remaining audio signals to produce a left output signal and to combine second selected ones of the surround audio signals and the remaining audio signals to produce a right output signal, wherein the first filter unit comprises a decimation unit to decimate low frequency components of the surround audio signals, wherein the first filter unit comprises:

a first delay unit to delay a left surround audio signal from among the surround audio signals for a first time period;

a second delay unit to delay a right surround audio signal from among the surround audio signals for a second time period;

a third delay unit to delay the left surround audio signal from among the surround audio signals for a third time period;

a fourth delay unit to delay the right surround audio signal from among the surround audio signals for a fourth time period;

a first gain unit to adjust an output gain of the third delay unit;

a second gain unit to adjust an output gain of the fourth delay unit;

a first addition unit to add an output of the first delay unit and an output of the second gain unit; and a second addition unit to add an output of the second delay unit and an output of the first gain unit.

16. The stereo sound generation apparatus of claim 15, further comprising:

a left speaker to output the left output signal; and a right speaker to output the right output signal.

17. The stereo sound generation apparatus of claim 16, wherein the left speaker and the right speaker are disposed a first predetermined distance apart with respect to each other, and the left and right speakers are disposed a second predetermined distance from the listening point such that the second predetermined distance is greater than the first predetermined distance.

18. The stereo sound generation apparatus of claim 15, wherein the surround audio signals comprise left and right surround signals, and the remaining audio signal comprise a left signal, a right signal, a center signal, and a low frequency effect signal.

19. A stereo sound generation apparatus to reproduce multi-channel audio input signals as two-channel output signals, the apparatus comprising:

a virtual surround filter unit to reduce a correlation between the two-channel audio signals from among the multi-channel audio input signals to generate a presence perception, and to convert the two-channel audio signals into a virtual sound source at a predetermined position;

a signal correction filter unit to correct a signal characteristic between remaining ones of the multi-channel audio input signals excluding the two-channel audio input signals and the two-channel audio signals output from the virtual surround filter unit; and an addition unit configured to add signals to be output to a first channel from among the multi-channel audio signals output from the virtual surround filter unit and the signal correction filter unit, and to add signals to be output to a second channel from among the multi-channel audio signals output from the virtual surround filter unit and the signal correction filter unit, wherein the virtual surround filter unit comprises a decimation unit to decimate low frequency components of the surround audio signals, wherein the virtual surround filter unit comprises:

a delay unit to delay first and second channel input signals with respective predetermined delay values;

a gain unit to adjust an output level of each of the first and second channel input signals delayed in the delay unit;

a first addition unit to add the first channel input signal and the gain- and delay-adjusted second channel signal;

a first filter unit to adjust a frequency characteristic of a signal output from the first addition unit;

a second addition unit to add the second channel input signal and the gain- and delay-adjusted first channel signal; and a second filter unit to adjust a frequency characteristic of a signal output from the second addition unit.

20. A stereo sound generation method to apply a virtual effect to two channel signals, the method comprising:

dividing each of first and second channel signals into a high frequency band and a low frequency band;

decimating each of the first and second channel low frequency band signals;

generating virtual sound sources by reducing a correlation between respective decimated signals and outputting the virtual sound sources at predetermined positions;

performing interpolation with respect to the first and second channel signals output as the virtual sound sources;

low-pass filtering the interpolated first and second channel signals; and adding the low-pass filtered first channel signal and the delayed high frequency first channel signal, and adding the low-pass filtered second channel signal and the delayed high frequency second channel signal.

21. The method of claim 20, wherein the generating of the virtual sound sources comprises:

performing preprocessing filtering by reducing correlation between respective decimated signals and generating a presence perception; and performing virtual speaker filtering by outputting the respective decimated signals as the virtual sound sources at predetermined positions.

22. A stereo sound generation method of reproducing multi-channel audio input signals as two-channel output signals, the method comprising:

reducing a correlation between the two-channel audio signals from among the multi-channel audio input signals and generating a presence perception;

converting the two-channel audio signals into a virtual sound source at a predetermined position; and adjusting remaining multi-channel audio signals, excluding the two-channel audio signals, according to an output level and a time delay of the converted two channel audio signals, and outputting the adjusted signals as two-channel signals, wherein the reduction of the correlation between the two-channel audio signals from among the multi-channel audio input signals and the generation of the presence perception comprises:

performing a first delaying operation by delaying a first channel audio signal for a first predetermined time;

performing a second delaying operation by delaying a second channel audio signal for a second predetermined time;

performing a third delaying operation by delaying the first channel audio signal for a third predetermined time;

performing a fourth delaying operation by delaying the second channel audio signal for a fourth predetermined time, performing a first addition by adding values obtained by multiplying a first predetermined gain by each of an output of the first delaying operation and an output of the second delaying operation;

performing a second addition by adding values obtained by multiplying a second predetermined gain by each of the output of the second delaying operation and an output of the third delaying operation;

performing a fifth delaying operation by filtering a first signal obtained by adding the output of the first delaying operation and an output of the fourth delaying operation, and delaying the first filtered signal for a fifth predetermined time;

performing a sixth delaying operation by filtering a second signal obtained by adding the output of the second delaying operation and the output of the third delaying operation, and delaying the second filtered signal for a sixth predetermined time; and performing third and fourth additions by adding outputs of the fifth and sixth delaying operations and the first and second channel audio signals, respectively.

23. The method of claim 22, further comprising:

after the outputting of the adjusted signals, adding signals to be output to a first channel, and adding signals to be output to a second channel.

24. The method of claim 22, wherein output signals of the third and fourth additions are multiplied by different gains, respectively.

25. The method of claim 22, wherein the first delaying operation and the sixth delaying operation are asymmetrical to each other.

26. The method of claim 22, wherein the converting of the two-channel audio signals into the virtual sound source at the predetermined position is performed through multiplication of a binaural synthesis filter matrix and a crosstalk canceling filter matrix.

* * * * *